US005701690A

United States Patent [19]

Miscio

[11] Patent Number: 5,701,690

[45] Date of Patent: Dec. 30, 1997

[54] DEVICE FOR FILLING A HOLE IN AN ICE RINK SURFACE

[76] Inventor: Raymond Miscio, RR#2 Minden, Ontario, Canada, K0M 2K0

[21] Appl. No.: 633,097

[22] Filed: Apr. 16, 1996

[51] Int. Cl.[6] ..... E01H 5/12

[52] U.S. Cl. ..... 37/219; 62/320; 299/24

[58] Field of Search ..... 62/235, 59, 66, 62/260, 320, 354; 37/219, 221, 222, 230, 233; 210/638, 652

[56] References Cited

U.S. PATENT DOCUMENTS

| | | | |
|---|---|---|---|
| 3,622,205 | 11/1971 | Zamboni | 37/219 X |
| 3,917,350 | 11/1975 | Bricher | 299/24 |
| 4,121,431 | 10/1978 | Meudec et al. | 62/66 |
| 4,741,173 | 5/1988 | Neumann | 62/298 |
| 5,191,772 | 3/1993 | Engel | 62/320 |

FOREIGN PATENT DOCUMENTS

| | | |
|---|---|---|
| 849787 | 8/1970 | Canada . |
| 1162064 | 2/1984 | Canada . |

*Primary Examiner*—Terry Lee Melius
*Assistant Examiner*—Robert Pezzuto

[57] ABSTRACT

The device fills a hole in an ice rink surface and has a chamber to receive a slush mixture. An access allows the slush mixture to be deposited into the chamber. The chamber has a lower end and a valve is located at the lower end for dispensing the slush mixture from the chamber. The valve includes a housing with an aperture and a valve member is dimensioned to fit within the aperture and is movable from a closed position to an open position. A trigger opens the valve to dispense the slush mixture. The valve can then be used to press the slush mixture into the hole, thereby to restore the ice rink surface.

17 Claims, 4 Drawing Sheets

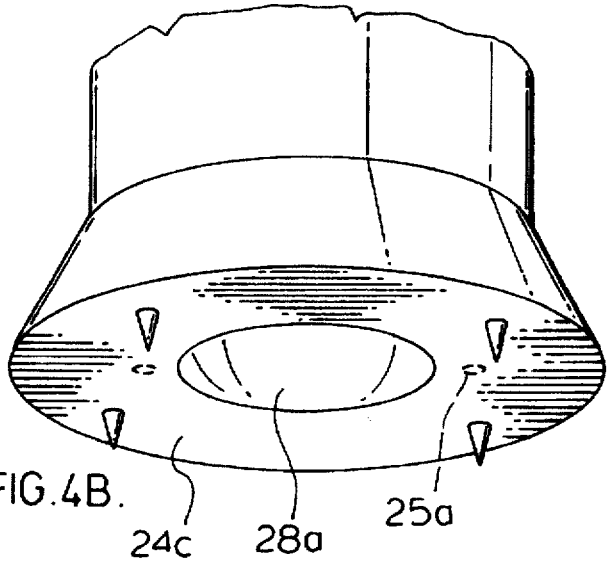
FIG.4B.
FIG. 5.
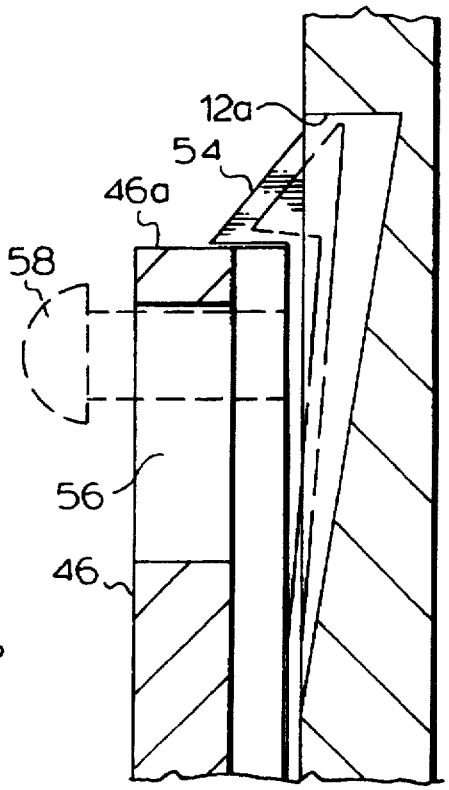
FIG.6.
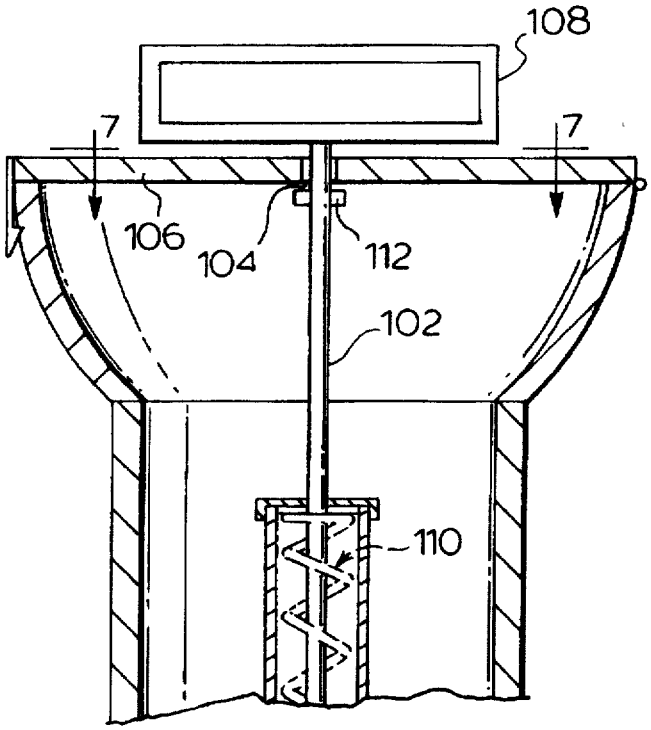
FIG. 7.
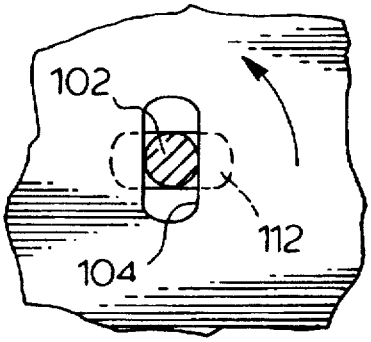

DEVICE FOR FILLING A HOLE IN AN ICE RINK SURFACE

BACKGROUND OF THE INVENTION

1. Field of the Invention

The present invention relates to ice rinks and more particular to improving the surface condition thereof.

2. Description of the Related Art

Ice rink sports such as hockey and figure skating are becoming increasingly popular in the traditional northern climates of North America, Scandinavia and Europe. The sports are also finding new markets now in southern climates and growth is expected to continue.

Improvements in ice making techniques allow for usable ice surfaces to be placed in areas traditionally thought of as inappropriate for ice sports. However, in both the traditional northern and now the newer southern climates, ice surface continues to be maintained in a labour intensive manner.

The routine wear that the ice surface experiences by the skating action is corrected by an ice resurfacing machine such as those sold under the trademark 'ZAMBONI'. However, it is common for the ice surface to become marked with relatively deep holes due to the spins and jumps in figure skating and perhaps collisions in hockey. These holes are corrected manually by arena personnel carrying a heavy pail of slush over the ice and, while on their knees, depositing slush in each hole and then packing the slush in the hole by gripping the edge of a hockey puck and tapping the puck over the just-deposited slush. While this technique is generally satisfactory, there remains a need to make this job less labour intensive and more consistent.

It is an object of the present invention to provide a novel technique to maintain the surface of an ice rink.

SUMMARY OF THE INVENTION

Briefly stated the invention involves a device for filling a hole in an ice rink surface, comprising:

a chamber to receive a slush mixture therein;

access means for depositing the slush mixture into the chamber;

valve means at one end of the chamber for dispensing the slush mixture from the chamber;

trigger means for opening the valve means so as to initiate the dispensing of the slush mixture;

impression means adjacent the valve means for pressing the slush mixture into the hole, thereby to restore the ice rink surface.

In another aspect of the present invention, there is provided a technique for filling a hole in an ice rink surface, comprising:

providing a chamber to receive a slush mixture therein with a valve at one end of the chamber for dispensing the slush mixture from the chamber; an aperture in the valve so as to allow for the passage of the such mixture from the chamber; and a trigger for opening the valve so as to initiate the dispensing of the slush mixture;

depositing the slush mixture into the chamber;

orienting the chamber over a hole in a hole in an ice rink surface; and activating the trigger to dispense a quantity of the slush mixture into the hole.

BRIEF DESCRIPTION OF THE DRAWINGS

A preferred embodiments of the present invention will now be described, by way of example only, with reference to the appended drawings in which:

FIG. 4*b* is a perspective view of a lower portion shown in FIG. 4;

FIG. 5 is a sectional view of another portion of the device illustrated in FIG. 1;

FIG. 6 is a sectional view of another device for filling a hole in an ice rink surface; and FIG. 7 is a sectional view taken on line 7—7 of FIG. 6.

DESCRIPTION OF THE PREFERRED EMBODIMENTS

Figure 1:
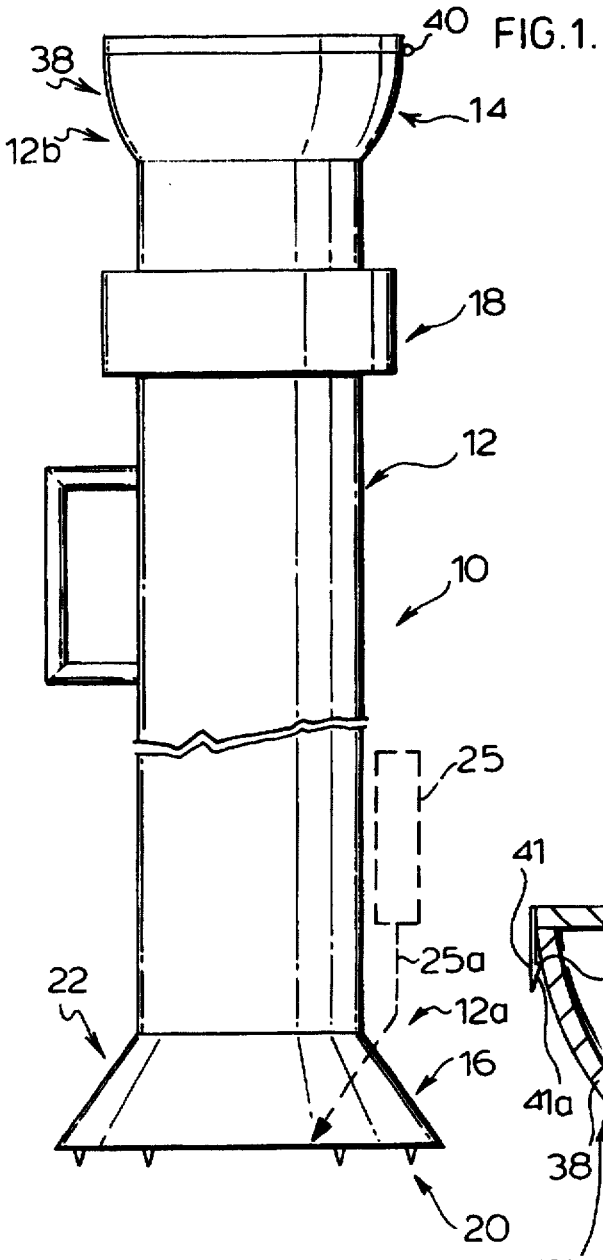
FIG. 1 is a side view of a device for filling a hole in an ice rink surface.

Referring to the figures, there is provided a device 10 for filling a hole in an ice rink surface, comprising a chamber 12 to receive a slush mixture therein; access means 14 for depositing the slush mixture into the chamber 12; valve means 16 at one end of the chamber 12 for dispensing the slush mixture from the chamber 12. Also provided is trigger means 18 for opening the valve means 16 so as to initiate the dispensing of the slush mixture; and impression means 20 adjacent the valve means 16 for pressing the slush mixture into the hole, thereby to restore the ice rink surface.

Figure 4:
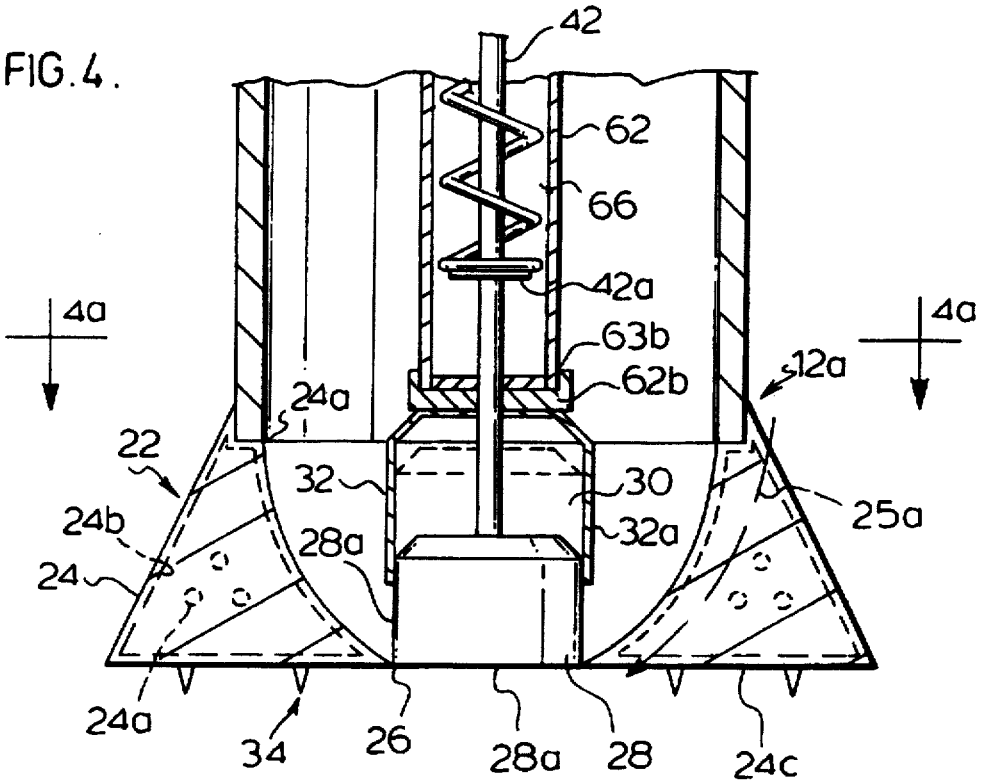
FIG. 4 is a sectional view of a lower portion of the device illustrated in FIG. 1.

The valve means 16 is provided in the form of a valve assembly located at the lower end 12*a* of the chamber 12. The valve assembly 16 includes a valve portion 22, the valve portion 22 having a housing 24 which is threadably engaged to the chamber 12 by way of a threaded section shown at 24*a*. The housing has an aperture 26 formed therein, and a valve member 28 is dimensioned to fit within the aperture 26. As shown in FIG. 4, the valve member 28 is arranged to be movable from a closed position as shown by solid lines to an open position as shown in phantom.

If desired, the housing may be solid or may instead be provided with an inner cavity shown by dashed lines at 24*b* to receive fluids or other suitable temperature conditioning materials therein to adjust the temperature of the slush mixture in the lower part of the chamber. The fluid may be of a convenient temperature, as for example may be provided from the warm faucet of an arena sink. Alternatively, the cavity may be provided with a heating element as shown at 24*d* to raise the temperature of the slush mixture. The cavity may also be filled with an insulating material if desired.

The temperature of the slush mixture leaving the aperture 26 may also be cooled by way of a $CO_2$ canister shown in dashed lines in FIG. 1 at 25 to deliver cooling gas to a region near the aperture as shown by a conduit 25*a* in dashed lines in FIGS. 1, 4 and 4*b*.

The valve portion 22 includes a passage 30 for the valve member 28 to travel from the closed position to the open position, the valve portion 22 further comprising shield means in the form of a shield member 32 for maintaining the slush mixture outside of the passage 30 in order to provide for an unobstructed travel of the valve member 28 therein.

The valve member 28 also has an outer periphery 28*a* and the shield member 32 has an outer apron 32*a* extending toward the valve member 28 and is shaped to engage the outer periphery.

The impression means 20 includes an impression surface formed both by a bottom edge 28*a* on the valve member and a lower surface 24*c* on the valve housing 24 surrounding the aperture 26 to engage the ice rink surface.

Also provided is a traction means 34 to enhance traction between the impression surface and the ice rink surface. In this case, the traction means includes cleats extending outwardly from the lower surface 24*c*. The dimensions of the cleats will depend on the degree of engagement desired between the impression surface and the ice and may be smaller than illustrated herein. The traction means may also include such things as sand paper, or for that matter be a roughened surface integrally formed on the housing.

Figure 2:
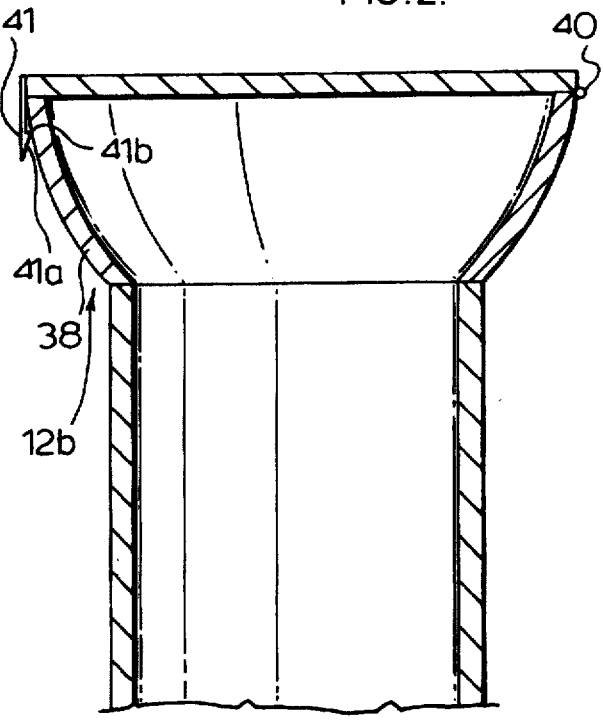
FIG. 2 is a sectional view of an upper portion of the device illustrated in FIG. 1.

Referring to FIG. 2, the chamber 12 has an upper end 12*b* and the access means 14 includes a lid 36 removably secured to the chamber 12. The chamber 12 includes a funnel portion 38 to direct the slush mixture to the central portion, and the lid is hinged to the funnel portion by way of hinge 40 to allow the lid to be opened without removal from the access means 14. In addition, the lid is provided with a releasable lock arrangement 41, in this case a resilient locking tab 41*a* engaged in a notch 41*b* formed in the funnel 38, to lock the lid in position.

Figure 3:
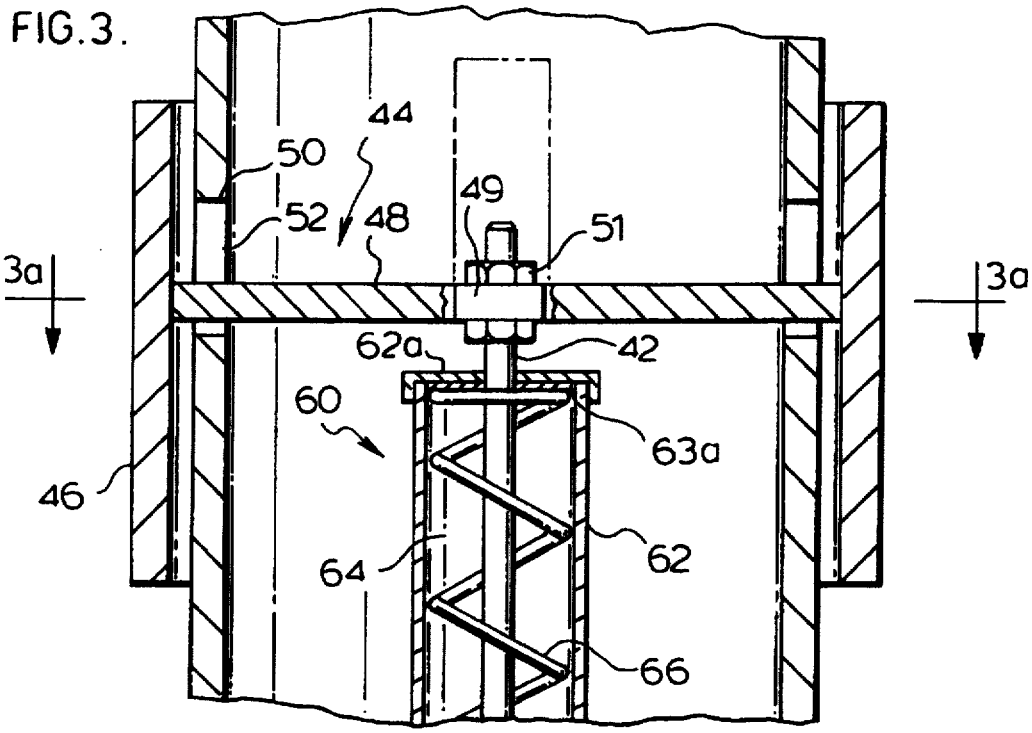
FIG. 3 is a sectional view of a central portion of the device illustrated in FIG. 1.
Figure 3A:
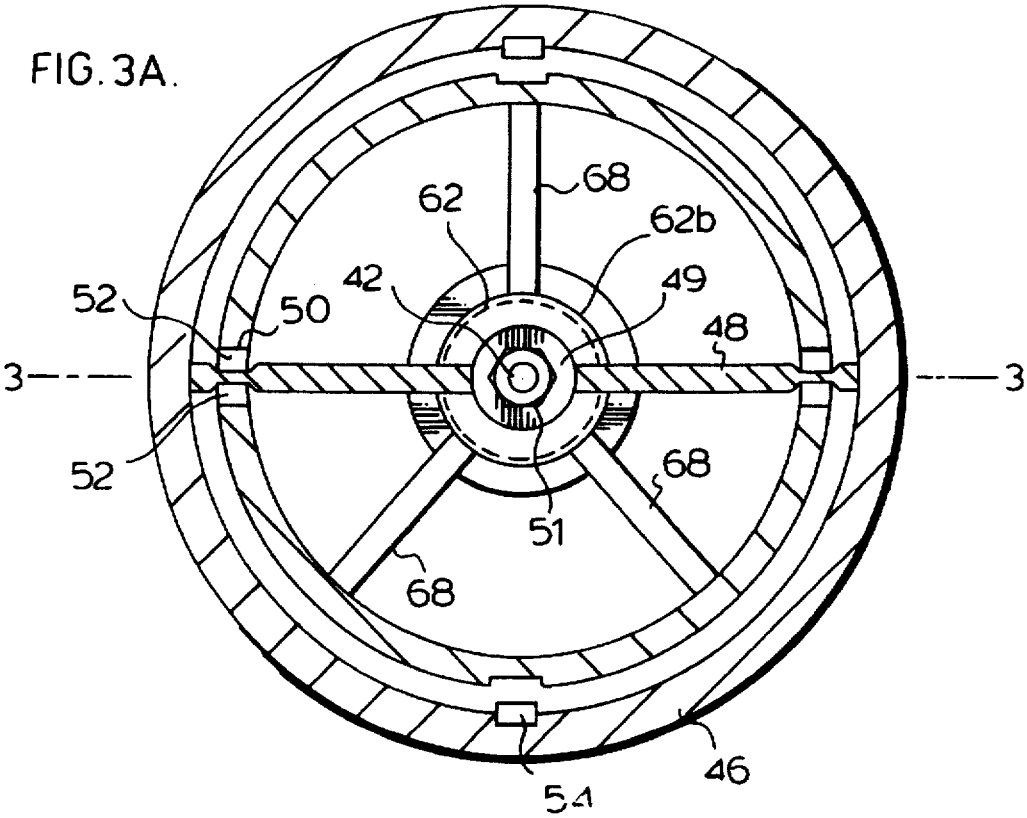
FIG. 3*a* is a sectional view taken on line 3*a*—3*a* of FIG. 3.

Referring to FIGS. 3 and 3*a*, the trigger means 18 includes a trigger arm 42 coupled with the valve member 28 as well as a trigger handle 44 assembly coupled with the trigger arm 42. The trigger handle assembly includes a trigger handle 46 located adjacent the chamber 12 and at least one coupling member 48 joined to a central hub portion 49 to couple the trigger handle with the trigger arm 42 by way of a pair of threaded fasteners 51.

It will also be seen that the trigger handle is located at the side of the chamber 12 and the chamber 12 has two longitudinal slits 50 formed therein with a coupling member 48 extending through each slit. Sealing means 52, in the form of a pair of resilient sealing plugs are further provided in the slit and on opposite sides of the coupling member to minimize passage of the slush mixture through the slit.

Referring to FIGS. 3*a* and 5, a removable locking means 54 is also provided for locking the trigger handle in a position corresponding to the closed position of the valve. As shown in more detail in FIG. 5, the locking means 54 is a notched locking member 54 with an abutment surface 54*a* and which is biased to a position where the abutment surface is engaged with a top surface 46*a* of the trigger handle 46. The chamber 12 is further provided with a recessed region 12*c* adjacent the locking member 54 to permit the locking member 54 to move therein when being moved from the locked position as shown in solid lines in FIG. 5 to an unlocked position as shown in phantom in FIG. 5. The trigger handle 46 is further provided with an opening 56 to permit the locking member to be forced by an operator's thumb or finger from its locked position. Alternatively, a button 58 may be provided in the opening 56 to provide for the forcing of the locking member from its locked position.

Referring to FIGS. 3 and 4, the trigger means 18 further includes support means 60 located in the chamber 12 for supporting the trigger arm 42 in position in a central region of the chamber 12. The support means includes an outer sleeve member 62 extending substantially the entire length of the chamber 12 and having an inner passage 64. The trigger arm 42 is received in and movable relative to the outer sleeve member 62.

The valve assembly 16 further comprising biasing means in the form of a compression spring 66 located in the inner passage 64 for biasing the valve member 28 toward the closed position. The compression spring 66 is held in the outer sleeve member 62 by way of threaded upper and lower end caps 62*a* and 62*b*. A flange 42*a* is provided on a lower region of the trigger arm 42 to provide a lower seat against which the spring may exert its downward biasing force. Upper and lower resilient sealing elements 63*a*, 63*b* are also provided in the upper and lower ends respectively of the outer sleeve member to seal against the entry of the slush mixture.

Figure 4A:
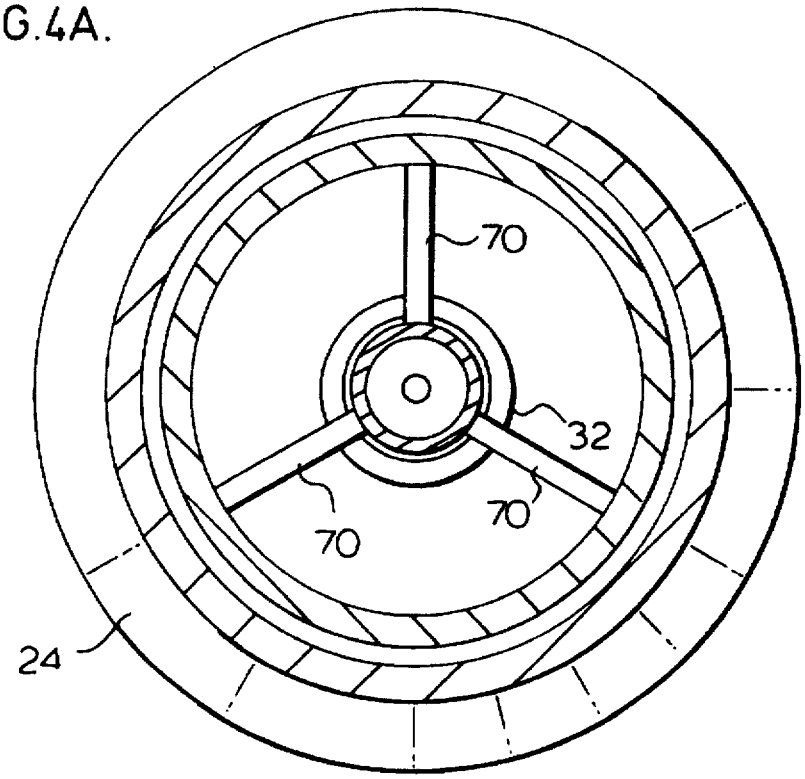
FIG. 4*a* is a sectional view taken on line 4*a*—4*a* of FIG. 4.

Referring to FIGS. 3*a* and 4*a*, the support means also includes a number of upper spanning members 68 and a number of lower spanning members 70, preferably three each, fixed at one end to the inner surface of the chamber 12 and at the other end to the outer face of the outer sleeve member 62 for positioning the outer sleeve member 62 in a central location in the chamber 12.

The device 10 or its component parts may be made from a number of suitable materials such as steel, aluminum or resilient materials such as plastic. In addition, the chamber may be integrally formed with the funnel portion and the valve assembly portion. Alternatively, the chamber, the funnel portion and the valve assembly may be separately formed to allow for different materials if necessary and coupled together in standard fashion such as for example with fasteners, fusing or a threaded or other suitable connection method.

The aperture should be a size sufficient to cover most holes that will be found following the regular use of an ice rink, which for example could vary from as little as one half inch to as much as several inches.

The chamber forms the majority of the height of the device 10 and is preferably of a size, such as about four feet in height, to enable an operator to use the device while standing. In use, the device is first filled with the slush mixture which is normally formed by simply mixing snow (such as the shavings collected from an ice resurfacing machine) with tap water and should have a consistency to flow from the device 10 and not to build up in an undesirable manner.

With the slush mixture in the device 10, the operator positions the device over a hole in the ice surface. The operator then grips the handle with two hands and releases the locking members 54. With the trigger handle 44 released, the operator applies upward pressure on the handle which in turn results in an upward forced being delivered on the valve member 28. When the upward force on the valve member 28 exceeds the downward force exerted thereon by the compression spring 66, the valve member is displaced from its closed position to its open position and in so doing travels toward and inside the shield member 43. This results a gap formed between the lowermost edge of the valve member 28 and the aperture 26 causing the downward release of the slush mixture out of the device 10 and into the waiting hole in the ice. After a relatively short period of time, which can be established with practice, the operator then releases the handle to return the valve member 28 to its closed position, thereby cutting off the supply of the slush mixture to the hole. The trigger handle then is reengaged with the locking member 54.

With the trigger handle locked, the bottom edge of the valve member and the lower surface 24*c* on the valve housing 24 surrounding the aperture 26 then form the impression surface which the operator may be used for pressing the slush mixture into the hole, thereby to restore the ice rink surface. This can be done, for example, by lifting the device 10 and tapping the impression surface against the ice surface.

The device 10 is provided with a number of threaded couplings allowing the device to be disassembled for cleaning and repair, such as with the threaded section 24*a* on the housing to expose the valve assembly, as well as the threaded upper and lower end caps 62*a* and 62*b* to gain access to the compression spring 66 and the upper and lower resilient sealing elements 63*a*, 63*b*.

Thus, the device 10 provides a technique for filling a hole in an ice rink surface, comprising the steps of: providing a chamber to receive a slush mixture therein with a valve at one end of the chamber for dispensing the slush mixture from the chamber; an aperture in the valve so as to allow for the passage of the such mixture from the chamber; and a trigger for opening the valve so as to initiate the dispensing of the slush mixture; depositing the slush mixture into the chamber; orienting the chamber over a hole in a hole in an ice rink surface; and activating the trigger to dispense a quantity of the slush mixture into the hole. The device 10 also provides for the use of an impression surface adjacent to the valve for pressing the slush mixture into the hole after the slush mixture has been dispensed therein.

While the device 10 has been illustrated with the use of a spring to provide a downward biasing force, it will be understood that the device may work equally well without such spring, provided sufficient instruction is provided to the user to exert the necessary downward force to return the valve member to its closed position.

A portion of another device for filling a hole in an ice rink surface is shown at 100 in FIGS. 6 and 7. In this case, the trigger means includes a trigger arm 102 coupled with the valve portion. In this case, the valve portion is identical to that shown in earlier embodiment. The trigger arm extends upwardly through a passage 104 in the lid 106 to extend upwardly and outwardly from the top surface of the lid. A trigger handle 108 is coupled with the trigger arm 102 and is movable upwardly with the trigger arm to open the valve portion and, if desired, under the biasing force of a spring shown in phantom at 110. The passage 104 is oblong and the trigger arm has a similarly shaped oblong latch 112 so that the arm may be rotated to a position wherein the oblong latch 112 fits through the passage 104. This provides a convenient method of locking the trigger handle in position with the valve portion closed. With this arrangement, the user may carry the device 100 with one hand on the handle and then position the device over the hole. With the impression surface against the ice surface, the user may then rotate the handle to position the oblong latch with the passage to release the handle and then lift the handle to bring the valve member to its open position. Thereafter, the user may simply reverse the procedure to close the valve.

I claim:

1. A device for filling a hole in an ice rink surface, comprising: a chamber to receive a slush mixture therein; access means for depositing said slush mixture into said chamber; valve means at one end of said chamber for dispensing said slush mixture from said chamber; trigger means for opening said valve means so as to initiate the dispensing of said slush mixture; impression means adjacent said valve means for pressing said slush mixture into said hole, thereby to restore said ice rink surface, wherein said chamber has a lower end, said valve means being located at said lower end, said valve means including a valve portion, said valve portion having a housing with an aperture formed therein, and a valve member dimensioned to fit within said aperture and movable from a closed position to an open position.

2. A device as defined in claim 1 wherein said valve portion includes a passageway for said valve member to travel from said closed position to said open position, said valve portion further comprising shield means for maintaining said slush mixture outside of said passage in order to provide for an unobstructed travel of said valve member therein.

3. A device as defined in claim 2 wherein said valve member has an outer periphery, said shield means includes a shield member with an outer apron extending toward said valve member and is shaped to engage said outer periphery.

4. A device as defined in claim 3 wherein said impression means includes an impression surface.

5. A device as defined in claim 4 wherein said value member has a bottom edge forming one portion of said impression surface.

6. A device as defined in claim 5 wherein said valve portion has a lower surface surrounding said aperture to engage said ice rink surface.

7. A device as defined in claim 6 further comprising traction means to enhance traction between said lower surface and said ice rink surface.

8. A device as defined in claim 7 wherein said traction means includes cleats extending outwardly from said lower surface.

9. A device as defined in claim 8 wherein said chamber has an upper end and said access means includes a lid removably secured to said chamber.

10. A device as defined in claim 9 wherein said trigger means includes a trigger arm coupled with said valve portion.

11. A device as defined in claim 10 wherein said trigger means includes a trigger handle assembly coupled with said trigger arm.

12. A device as defined in claim 11 wherein said trigger handle assembly includes a trigger handle located adjacent said chamber and at least one coupling member to couple said trigger handle with said trigger arm.

13. A device as defined in claim 12 wherein said trigger handle is located to one side of said chamber, said chamber has at least one longitudinal slit formed therein, said coupling member extending through said slit and sealing means further provided in said slit to minimize passage of said slush mixture there through.

14. A device as defined in claim 13 further comprising removable locking means for locking said handle in a position corresponding to the closed position of said valve.

15. A device as defined in claim 14 wherein said trigger means further includes support means located in said chamber for supporting said trigger arm in position in a central region of said chamber.

16. A device as defined in claim 15 wherein said support means includes an outer sleeve member, extending substantially the entire length of said chamber, having an inner passage, said trigger arm being received in and movable relative to said outer sleeve member.

17. A device as defined in claim 16 wherein said valve means further comprising biasing means located in said inner passage for biasing said valve member toward said closed position.

* * * * *